US005467261A

United States Patent [19]

Whetstone

[11] Patent Number: 5,467,261

[45] Date of Patent: Nov. 14, 1995

[54] MAGNETIC SHIELD FOR DROP LIGHTS

[76] Inventor: Gary D. Whetstone, 229 Dalton La., Centreville, Miss. 39631

[21] Appl. No.: 323,626

[22] Filed: Oct. 17, 1994

[51] Int. Cl.[6] ..... F21V 21/08

[52] U.S. Cl. ..... 362/398; 362/396; 362/400

[58] Field of Search ..... 362/376, 396, 362/398, 399, 400

[56] References Cited

U.S. PATENT DOCUMENTS

| | | | |
|---|---|---|---|
| 2,987,612 | 6/1961 | Haulter | 362/398 X |
| 3,479,500 | 11/1969 | Duddy | 362/396 X |
| 4,019,047 | 4/1977 | Frey | 362/396 X |
| 4,128,226 | 12/1978 | Ross et al. | 362/396 X |
| 4,470,106 | 9/1984 | Norton | 362/427 X |
| 4,564,894 | 1/1986 | Gonzalez | 362/398 |
| 4,672,515 | 6/1987 | Baker | 362/430 X |
| 4,727,462 | 2/1988 | Komonko | 362/398 |

*Primary Examiner*—Stephen F. Husar

[57] ABSTRACT

A magnetic shield for drop lights with the shield on the rear side and magnets secured with respect thereto comprising a cylindrical handle having an exterior end and an interior end; an electrical light socket for receiving a bulb secured to the outboard end of the handle; a front guard formed of wires in a cage-like configuration positioned over the front half of the bulb for the passage of light therethrough; a shield on the rear half of the lamp and coupled to the front guard, the shield having an enlarged rectangular central plate centrally located in the rear thereof, the shield also having a pair of laterally disposed rectangular plates with their long edges secured to the long edges of the central plate with the side plates each forming an obtuse angle; the upper and lower ends of the central plate being formed with a trapezoidal type member secured at their interior ends to the upper and lower edges of the central plate and triangular plates coupling the side plates with the upper and lower plates; and magnets secured to the central plate, side plates and top plate for allowing the lamp to be positioned and secured at any of a plurality of locations.

4 Claims, 4 Drawing Sheets

MAGNETIC SHIELD FOR DROP LIGHTS

BACKGROUND OF THE INVENTION

1. Field of the Invention

The present invention relates to a new and improved magnetic shield for drop lights and, more particularly, pertains to positioning a drop light at any location as a function of the available space.

2. Description of the Prior Art

The use of lights and lamps of various designs and configurations is known in the prior art. More specifically, lights and lamps of various designs and configurations heretofore devised and utilized for the purpose of illuminating areas with lamps having housings through a wide variety of apparatuses and methods are known to consist basically of familiar, expected, and obvious structural configurations, notwithstanding the myriad of designs encompassed by the crowded prior art which has been developed for the fulfillment of countless objectives and requirements.

The prior art discloses a large number of lights and lamps of various designs and configurations. By way of example, U.S. Pat. Nos. 3,479,500 and 4,019,047 to Duddy disclose a trouble lamp for mechanics.

U.S. Pat. No. 4,128,226 to Ross discloses an extension light assembly.

U.S. Pat. No. 4,470,106 to Norton discloses a shop light.

Lastly, U.S. Pat. No. 4,672,515 to Baker discloses a utility light adjusting and securing device.

In this respect, the magnetic shield for drop lights according to the present invention substantially departs from the conventional concepts and designs of the prior art, and in doing so provides an apparatus primarily developed for the purpose of positioning a drop light at any location as a function of the available space.

Therefore, it can be appreciated that there exists a continuing need for a new and improved magnetic shield for drop lights which can be used for positioning a drop light at any location as a function of the available space. In this regard, the present invention substantially fulfills this need.

SUMMARY OF THE INVENTION

In view of the foregoing disadvantages inherent in the known types of lights and lamps of various designs and configurations now present in the prior art, the present invention provides a new and improved magnetic shield for drop lights. As such, the general purpose of the present invention, which will be described subsequently in greater detail, is to provide a new and improved magnetic shield for drop lights and methods which have all the advantages of the prior art and none of the disadvantages.

To attain this, the present invention essentially comprises a new and improved magnetic shield for drop lights comprising, in combination, a cylindrical handle having an exterior end and an interior end; an electrical light socket for receiving a bulb secured to the outboard end of the handle; a front guard formed of wires in a cage-like configuration positioned over the front half of the bulb for the passage of light therethrough; a shield on the rear half of the lamp and coupled to the front guard, the shield having an enlarged rectangular central plate centrally located in the rear thereof, the shield also having a pair of laterally disposed rectangular plates with their long edges secured to the long edges of the central plate with the side plates each forming an angle of about 135 degrees plus or minus ten percent; the upper and lower ends of the central plate being formed with a trapezoidal type member secured at their interior ends to the upper and lower edges of the central plate and triangular plates coupling the side plates with the upper and lower plates; magnets secured to the central plate, side plates and top plate for allowing the lamp to be positioned and secured at any of a plurality of locations; a hook formed at the upper edge of the lamp for suspension purposes; and electrical lines extending through the handle to the light socket at one end and adapted to be coupled to a source of potential at the other end.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved magnetic shield for drop lights which has all the advantages of the prior art lights and lamps of various designs and configurations and none of the disadvantages.

It is another object of the present invention to provide a new and improved magnetic shield for drop lights which may be easily and efficiently manufactured and marketed.

It is a further object of the present invention to provide a new and improved magnetic shield for drop lights which is of a durable and reliable construction.

An even further object of the present invention is to provide a new and improved magnetic shield for drop lights which is susceptible of a low cost of manufacture with regard to both materials and labor, and which accordingly is then susceptible of low prices of sale to the consuming public, thereby making such a magnetic shield for drop lights economically available to the buying public.

Still yet another object of the present invention is to provide a new and improved magnetic shield for drop lights which provides in the apparatuses and methods of the prior art some of the advantages thereof, while simultaneously overcoming some of the disadvantages normally associated therewith.

Even still another object of the present invention is to position a drop light at any location as a function of the available space.

Lastly, it is an object of the present invention to provide a magnetic shield for drop lights with magnets secured with respect thereto comprising a cylindrical handle having an exterior end and an interior end; an electrical light socket for receiving a bulb secured to the outboard end of the handle; a front guard formed of wires in a cage-like configuration positioned over the front half of the bulb for the passage of light therethrough; a shield on the rear half of the lamp and coupled to the front guard, the shield having an enlarged rectangular central plate centrally located in the rear thereof, the shield also having a pair of laterally disposed rectangular plates with their long edges secured to the long edges of the central plate with the side plates each forming an obtuse angle; the upper and lower ends of the central plate being formed with a trapezoidal type member secured at their interior ends to the upper and lower edges of the central plate and triangular plates coupling the side plates with the upper and lower plates; and magnets secured to the central plate, side plates and top plate for allowing the lamp to be positioned and secured at any of a plurality of locations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
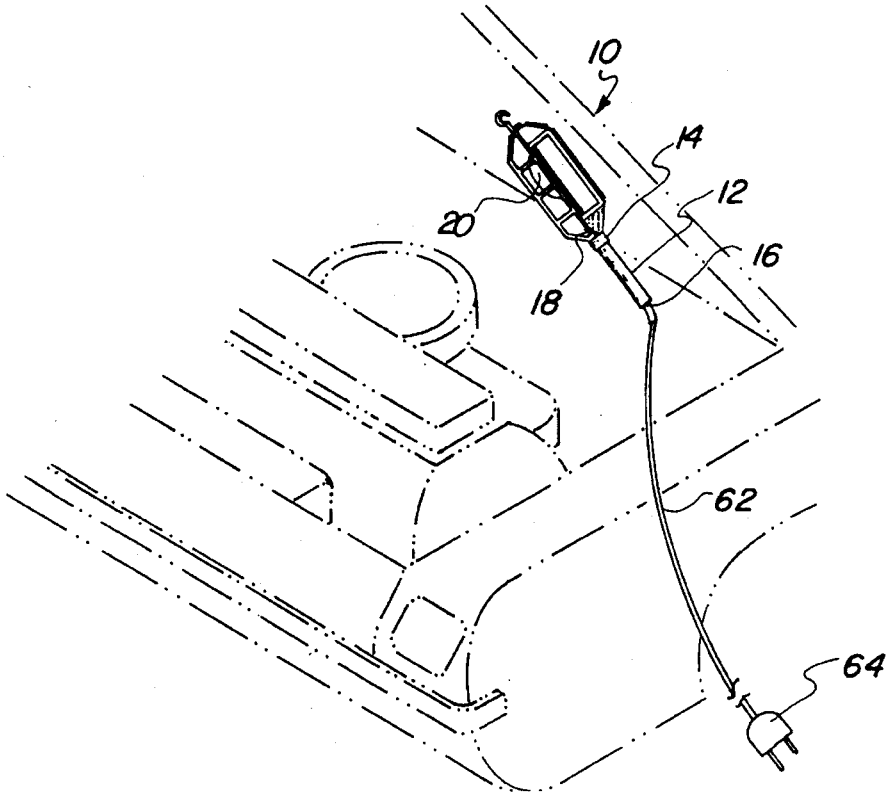
FIG. 1 is a perspective illustration of the preferred embodiment of the new and improved magnetic shield for drop lights constructed in accordance with the principles of the present invention.
Figure 2:
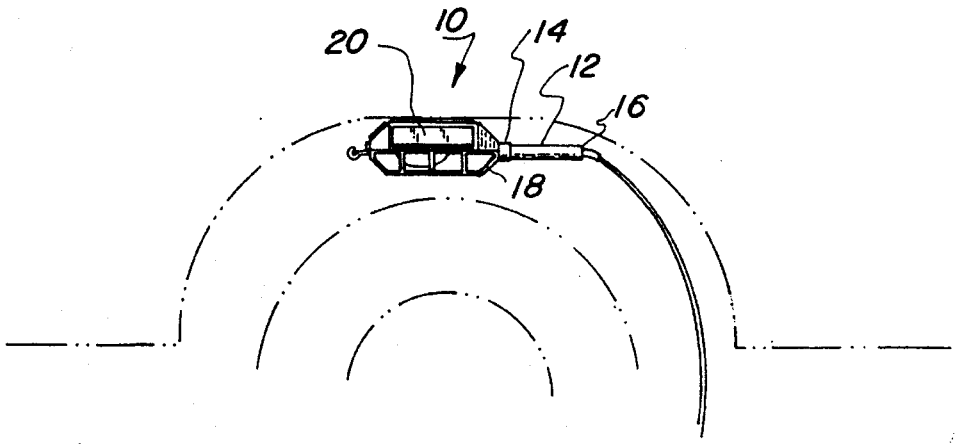
FIG. 2 is a side elevation of the lamp of FIG. 1 but shown in an alternate position.
Figure 4:
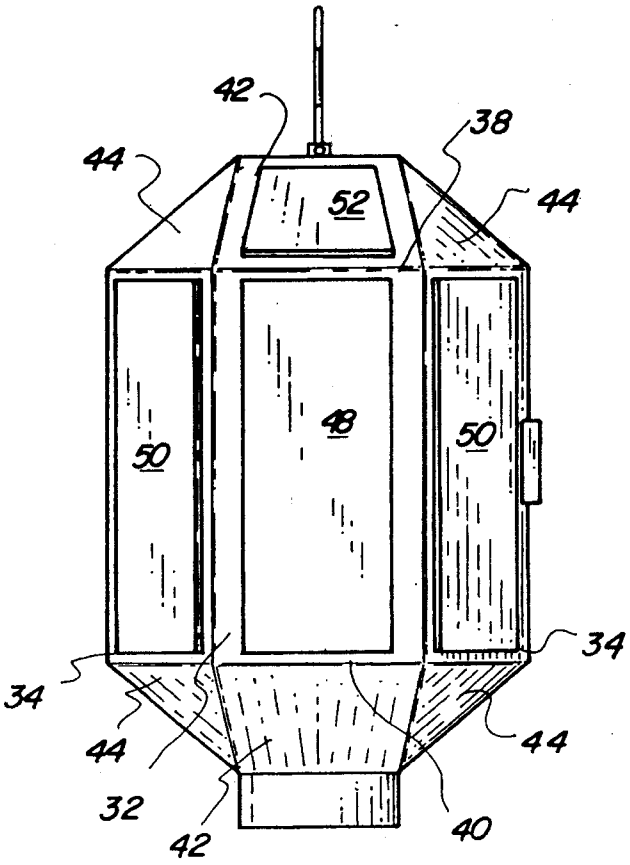
FIG. 4 is a rear elevational view of the lamp of the prior Figure.
Figure 3:
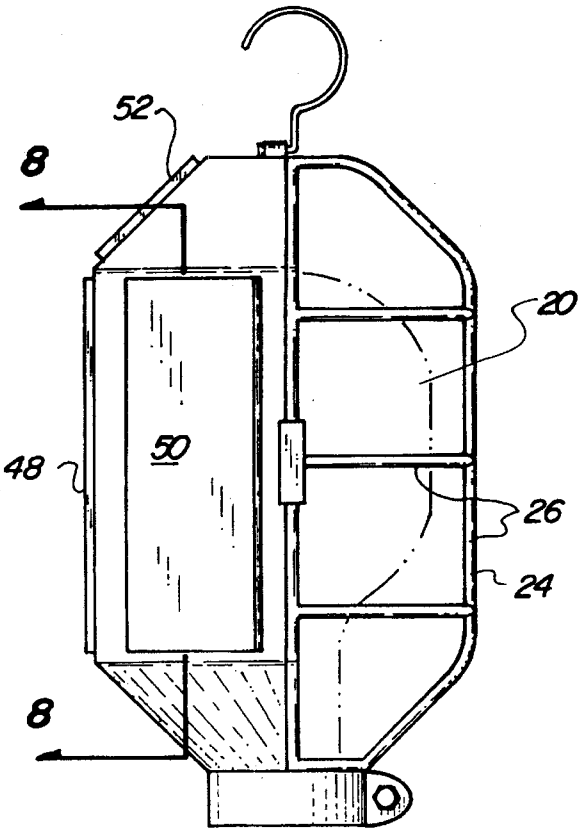
FIG. 3 is a side elevational view of the lamp shown in FIGS. 1 and 2.

With reference now to the drawings, and in particular to FIG. 1 thereof, the preferred embodiment of the new and improved magnetic shield for drop lights embodying the principles and concepts of the present invention and generally designated by the reference numeral 10 will be described.

The present invention, the new and improved magnetic shield for drop lights, is a system comprised of a plurality of components. The components in their broadest context include a handle, a light socket, a front guard, shield, magnets, a hook and electrical line. Each of the individual components is specifically configured and correlated one with respect thereto to the other to attain the desired objectives.

A major component of the present system 10 is a cylindrical handle 12. The handle has an essentially circular cross-sectional configuration. It has an exterior end 14 and an interior end 16. Secured with respect to the outboard end of the handle is an electrical light socket 18. Such socket is of a conventional configuration adapted to receive a light bulb 20 to produce illumination.

Surrounding at least a portion of the bulb is a front guard 24. Such front guard is formed of a plurality of wires 26 horizontally and vertically in a cage-like configuration. It is preferably positioned over the front half of the bulb. This allows for the passage of light therethrough for the desired illumination of a particular area.

Adjacent to the rear half of the lamp is a shield 30. The shield is coupled around its periphery to the front guard. The shield has an enlarged rectangular central plate 32. Such plate is essentially located in the rear of the device. The shield also has a pair of laterally disposed rectangular side plates 34. Such plates have long edges secured to the long edges of the central plate. The shield also has side plates 36. Each side plate forms an angle of about 135 degrees plus or minus ten percent with respect to the central plate.

The upper and lower ends 38, 40 of the central plate are formed with a trapezoidal-shaped member 42. Each such member is secured at its interior ends to the upper and lower edges of the central plate. In addition, triangular plates 44 couple the side plates with the upper and lower plates.

Greater utility in securing the light of the system 10 of the present invention are magnets. Such magnets include a central magnet 48 secured to the central plate on its exterior face. In addition, magnets 50 are secured to the side panels. Additional magnets 52 are secured to the top panel. Together, the four magnets at various angles with respect to each other and with respect to the lamp allow the lamp to be positioned and secured at any of a plurality of locations wherein metallic surfaces exist.

Further utility is provided through a hook 56. Such hook is formed in a projecting aperture 58 at the upper extent of the shield. This allows the upper edge of the lamp to be suspended from a location wherein a fixed member exists which in the absence of metallic members for being held by magnetism.

Figure 6:
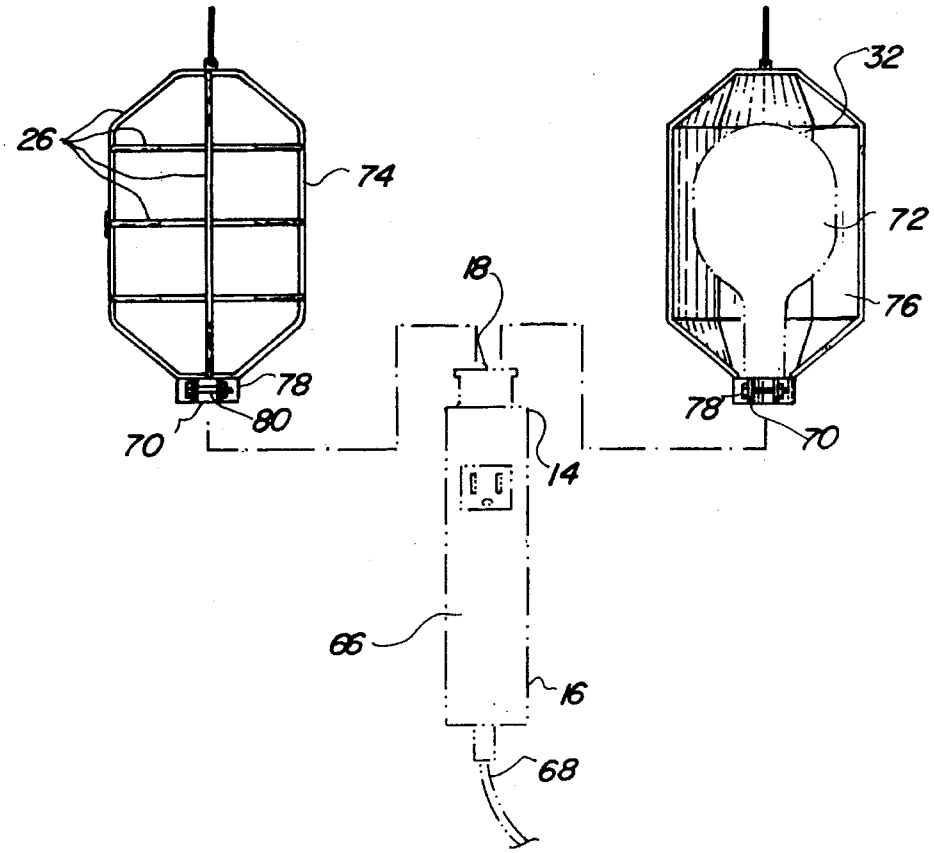
FIG. 6 is an exploded illustration of the lamp of the prior Figure.
Figure 5:
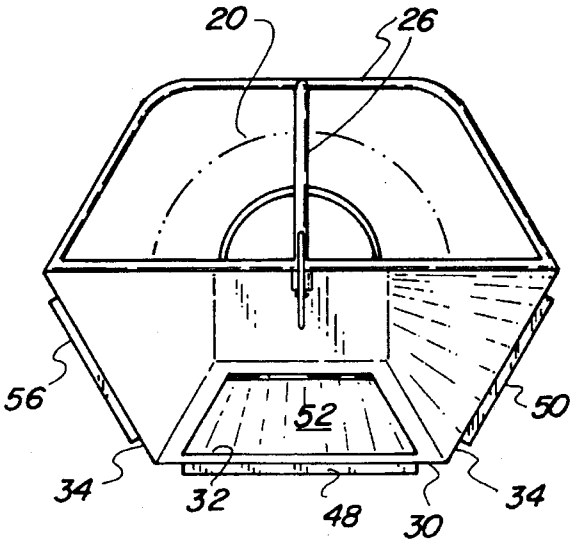
FIG. 5 is a top elevational view of the lamp of the prior Figure.
Figure 8:
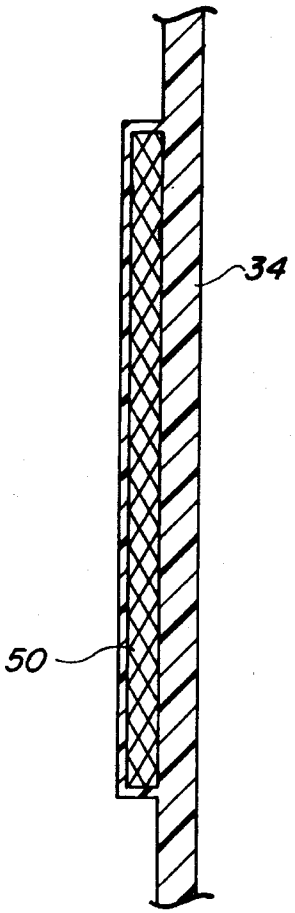
FIG. 8 is a cross-sectional view through line 8—8 of FIG. 3.
Figure 7:
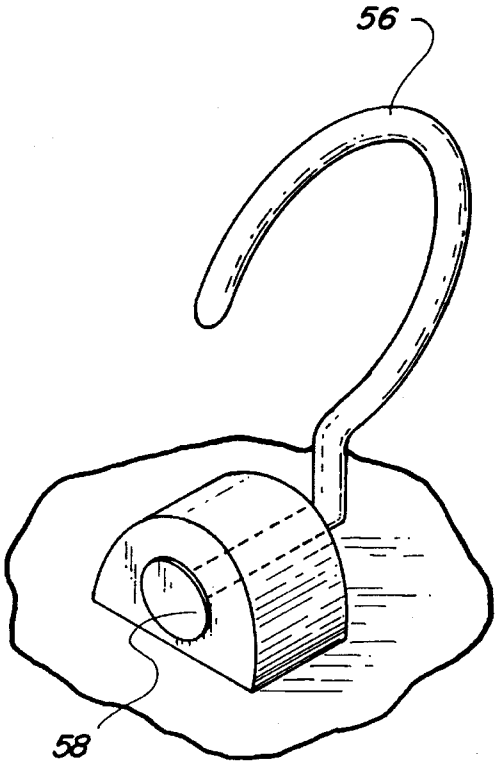
FIG. 7 is an enlarged perspective showing of the hook of the prior Figure.

Lastly, electrical lines 62 are provided to extend through the handle to the light socket. This is at the outboard end of the electrical line. The inboard ends of the electrical lines include a coupling component 64 adapted to be coupled to a source of potential for providing electrical power to the socket and bulb to effect the desired illumination. An alternate embodiment of the invention is shown in FIG. 6. In such alternate embodiment, a single handle 66 is utilized. Such handle has its electrical lines 68 at the outboard end of the handle extending at opposite directions. This allows a single handle and single source of potential to power a plurality of light sockets 70 and bulbs 72 in a plurality of lights with their own front guards 74 and shields 76. In such alternate embodiment as well as in the primary embodiment, a clamp 78 is provided with a bolt 80 and associated nut to allow tightening the device with respect to an adjacent surface, as for example, the handle, and also extends its utility to provide illumination at plural locations.

The present invention is designed to replace the bulb shield originally incorporated on any shop light, commonly called the drop light. Like its conventional counterpart, it has a caged area at its frontal opening to protect against inadvertent burns, and a hook extending from its top. However, the innovation in this idea is the incorporation of four angled surfaces which form the enclosed area of the shield. In addition, a magnet is embedded into each of these surfaces.

Three of these surfaces extent for the entire height of the shield and are parallel to the longitudinal axis of the bulb but angled relative to each other in the plane. In other words, if cut transversely, the cross sectional shape would appear to be one-half of a hexagon. The fourth surface is at the top rear area of the shield and it describes an approximate angle of forty five degrees with the axis of the bulb.

Hence, it can be seen that the present invention can be hung in a conventional fashion, or it can be placed on any metallic surface to best suit the optimum illumination angle required for any job. As positioned, the present invention will not turn to shine in one's eyes, nor rotate away from the work area.

The present invention is ideal for use by an automotive mechanic and can be placed on objects, fenders, hoods, A-frames, driveshafts or any number of other components. Best of all, it will stay firmly in place until it is moved with a conscious act and not "wander on its own". The present invention should indeed be a valuable acquisition for anyone having the need to use this type of light.

As to the manner of usage and operation of the present invention, the same should be apparent from the above description. Accordingly, no further discussion relating to the manner of usage and operation will be provided.

With respect thereto to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved drop light comprising, in combination:

a cylindrical handle having an exterior end and an interior end;

an electrical light socket for receiving a bulb secured to the exterior end of the handle;

a front guard formed of wires in a cage-like configuration positioned over the front half of the bulb for the passage of light therethrough;

a shield on the rear half of the light and coupled to the front guard, the shield having an enlarged rectangular central plate centrally located in the rear thereof, the shield also having a pair of laterally disposed rectangular side plates with their long edges secured to the long edges of the central plate with the side plates each forming an angle of about 135 degrees plus or minus ten percent;

the upper and lower ends of the central plate being formed with a trapezoidal type member secured at their interior ends to the upper and lower edges of the central plate and triangular plates coupling the side plates with the upper and lower ends;

magnets secured to the central plate, side plates and one trapezoidal type member for allowing the lamp to be positioned and secured at any of a plurality of locations;

a hook formed at the upper edge of the light for suspension purposes; and electrical lines extending through the handle to the light socket at one end and adapted to be coupled to a source of potential at the other end.

2. A magnetic shield for drop lights of the type having a cylindrical handle having an exterior end and an interior end; an electrical light socket for receiving a bulb secured to the exterior end of the handle; a front guard formed of wires in a cage-like configuration positioned over the front half of the bulb for the passage of light therethrough; a shield on the rear half of the light and coupled to the front guard, the shield having an enlarged rectangular central plate centrally located in the rear thereof, the shield also having a pair of laterally disposed rectangular side plates with their long edges secured to the long edges of the central plate with the side plates each forming an obtuse angle; and the upper and lower ends of the central plate being formed with a trapezoidal type member secured at their interior ends to the upper and lower edges of the central plate and triangular plates coupling the side plates with the upper and lower ends; the improvement comprising:

magnets secured to the central plate, side plates and one trapezoidal type member for allowing the light to be positioned and secured at any of a plurality of locations.

3. The apparatus as set forth in claim 2 and further including:

a hook formed at the upper edge of the light for suspension purposes.

4. The apparatus as set forth in claim 2 and further including:

electrical lines extending through the handle to the light socket at one end and adapted to be coupled to a source of potential at the other end.

* * * * *